United States Patent [19]

Walsh

[11] 4,450,652

[45] May 29, 1984

[54] TEMPERATURE CONTROL FOR WAFER POLISHING

[75] Inventor: Robert J. Walsh, Ballwin, Mo.

[73] Assignee: Monsanto Company, St. Louis, Mo.

[21] Appl. No.: 299,378

[22] Filed: Sep. 4, 1981

[51] Int. Cl.[3] ..... B24B 7/04

[52] U.S. Cl. ..... 51/131.4; 51/165.73; 51/322; 51/356

[58] Field of Search ..... 51/322, 165.73, 131.1, 51/131.3, 131.4, 13.5, 356, 131.2

[56] References Cited

U.S. PATENT DOCUMENTS

| | | | |
|---|---|---|---|
| 2,869,294 | 1/1959 | Boettcher | 51/131.2 |
| 3,571,978 | 3/1971 | Day | 51/131.4 |
| 3,916,573 | 11/1975 | Elbe | 51/165.73 |
| 4,001,980 | 1/1977 | Wallin | 51/165.72 |
| 4,313,284 | 2/1982 | Walsh | 51/131.4 |

FOREIGN PATENT DOCUMENTS

| | | | |
|---|---|---|---|
| 56-48112 | 12/1981 | Japan | 51/131.4 |

*Primary Examiner*—Harold D. Whitehead
*Attorney, Agent, or Firm*—P. L. Passley

[57] ABSTRACT

A wafer workpiece polishing temperature control method and apparatus are provided wherein wafers are mounted upon a rotatable pressure plate assembly positioned in rotatable contact with a turntable assembly supported polishing pad, the turntable assembly having internal fluid cooling means, the wafer polishing temperature control being achieved through responsive closed loop electromechanical means activated by variation of polishing pressure upon the wafers and the polishing pad.

9 Claims, 2 Drawing Figures

TEMPERATURE CONTROL FOR WAFER POLISHING

Background of the Invention

This invention relates to processing of thin semiconductor wafers such as slices of semiconductor silicon and, more particularly, to an improved method and apparatus for polishing wafers having uniform flatness of the polished surface, the improved polished wafer flatness is achieved through finite temperature control of the polishing environment. Finite polishing temperature control is made possible by providing a substantially constant thermal polishing environment wherein variation of pressure upon the polishing environment permits immediate temperature control. Timely and finite temperature control of the polishing environment also reduces the amount of thermal and mechanical bow found in such apparatus, for example, the turntable which is internally cooled. Wafer flatness as a result of polishing is also dependent upon contact surface profile of the wafers and the pressure plate in contact with the polishing surface which is supported by the turntable; thus, responsive and timely temperature control tuning plays a significant role in the polishing of semiconductor wafers.

Modern chemical-mechanical semiconductor polishing processes are typically carried out on equipment where the wafers are secured to a carrier plate by a mounting medium with the wafers having a load or pressure applied to the carrier and to the wafers by a pressure plate so as to press the wafers into frictional contact with a polishing pad mounted on a rotating turntable. The carrier and pressure plate also rotate as a result of either the driving friction from the turntable or rotation drive means directly attached to the pressure plate. Frictional heat generated at the wafer surface enhances the chemical action of the polishing fluid and thus increases the polishing rate. The polishing rate being a function of temperature stresses the importance of achieving immediate and exact temperature control of the polishing environment. Polishing fluids suitable for use in the present invention are disclosed and claimed in Walsh et al., U.S. Pat. No. 3,170,273.

Increased electronics industry demands for polished semiconductor wafers have promoted need for faster polishing rates requiring sizeable loads and substantial power input on polishing apparatus. This increased power input appears as frictional heat at the wafer polishing surface. In order to prevent excessive temperature buildup, heat is removed from the system by cooling the turntable. A typical turntable cooling system consists of a co-axial cooling water inlet and outlet through a turntable shaft along with cooling channels inside the turntable having appropriate baffles in order to prevent bypassing between inlet and outlet. However, it has been found that such an apparatus is not sufficient for temperature control under modern polishing requirements, i.e. the need for instantaneous temperature adjustment. The known methods of internally cooling the turntable do not provide quick or suitable temperature differential gradients since cooling fluid supply or volume are constant and the temperature of said fluid cannot be adjusted quickly nor can the temperature of the turntable be adjusted in a quick and precise manner through cooling means only. No matter the improved systems, temperature differences within the polishing environment result in thermal expansion differentials causing the turntable surface to deflect toward the cooled surface from the axis of rotation to the outside edge. Such thermal bowing is controllable and can be managed without flatness interference of the finished product if the temperature gradient within the turntable is carefully controlled within close tolerances.

A unique system has been developed through the operation of this invention for temperature control of semiconductor wafer polishing apparatus or other similar polishing apparatus wherein the system provides a turntable cooling water supply temperature which is maintained at a substantially constant temperature and relies on temperature control through the variation of polishing environment pressure. Polishing pad temperature control is achieved by fast response, closed loop control system which varies the polishing pressure as necessary to hold the pad temperature constant. Because of this dual temperature control system, i.e. the constant cooling of the turntable and the polishing pad temperature control, a constant temperature is maintained on both top and bottom surfaces of the turntable which results in a constant level of thermal distortion or bow. This phenomenon can then be compensated readily by generating a constant level of matching bow in the wafer carrier plate. By comparison, prior art methods usually control polishing pad temperature by varying the flow rate of the turntable cooling water. This process provides a system which responds much more slowly to thermal needs and gives less precise temperature control to the polishing environment. More importantly, however, varying the coolant flow rate changes the delta or thermal gradient across the turntable and changes its thermal distortion making it impossible to optimumly compensate for the turntable distortions by using a constant distortion of the carrier plate.

The wafer carrier is thermally insulated from the pressure plate by a resilient pressure pad. Therefore, the carrier approaches thermal equilibrium at a substantially uniform temperature and remains flat. The difference which is encountered between the plane defined by the wafers and the thermal bowed surface of the turntable can be compensated by geometric means in order to avoid excessive stock removal toward the center of the carrier causing non-uniform wafer thickness and poor flatness. Recent technological advances have enhanced methods of mounting the semiconductor wafers to the carrier plate which allow the wafers to be subjected to operations including washing, lapping, polishing and the like without mechanical distortion or unflatness of the polishing wafer. Such methodologies and apparatus have been disclosed and claimed by the invention presented in the recent Walsh U.S. applications, Ser. No. 126,807 entitled "Method and Apparatus For Wax Mounting of Thin Wafers for Polishing" now U.S. Pat. No. 4,316,757; and Ser. No. 134,714 entitled "Method and Apparatus For Improving Flatness of Polished Wafers" now U.S. Pat. No. 4,313,284.

The corrections as shown by the Walsh mounting methods are of assistance in achieving uniform polished flatness of semiconductor wafers; however, modern requirements of the semiconductor industry regarding polished silicon wafers cannot tolerate even the smallest surface flatness variations. The difficulties encountered in mounting of the wafers and accommodating the thermodynamic bowing of mechanical apparatus require additional technical input such as instantaneous and sensitive polishing environment temperature control means. Control means which rely upon fluid cooling variation either in temperature or in volume do not afford the timely or sensitivity temperature control that is necessary in order to achieve a stable geometric polishing wafer to polishing pad planar relationship. Accommodations for the bow as well as for the loading of the wafers during polishing must be made. In the manufacture of VLSI circuits, a high density of the circuit elements must be created on a silicon wafer requiring an extraordinarily high order of precision and resolution calling for wafer flatness heretofore not required. The necessary polished wafer flatness for such applications, for example, less than about 2 micrometers peak to valley, cannot be achieved at high polishing rates if the carrier mounted wafers are polished in an environment having sluggish temperature control which can be adjusted only through slow thermal adjustments of cooling fluids.

SUMMARY OF THE INVENTION

It is an object of the invention to provide a method for improving polished wafer flatness through maintaining a turntable thermal distortion constant through constant cooling fluid temperature and flow rate in combination with constant polishing temperature achieved through pressure control means.

It is another object of the present invention to provide a method for quick response, closed loop control systems for polishing environment through constant monitoring of the polishing environment temperature.

It is a further object of the present invention to provide a method of the character stated permitting polishing of wafers to an extraordinarily high degree of flatness, which is conducive to the manufacture of VLSI circuits.

It is a still further object of the present invention to provide a method of the character stated which can be practiced simply and easily within the context of large scale, mass production manufacture and polishing of monocrystal silicon wafers and the like.

It is another object of the invention to provide a method of the character stated which can be practiced with a minimum of manual steps and which is amenable to automation.

It is a further object of the invention to provide apparatus which affords dual temperature control polishing at a constant temperature maintainable on both the top and bottom surfaces of the turntable which results in a constant level of thermal distortion which is compensatable by generating a constant level of matching bow in the wafer carrier plate.

Other objects and features of the invention will be in part apparent and in part pointed out hereinbelow.

BRIEF DESCRIPTION OF THE DRAWINGS

Correspondingly, reference characters indicate corresponding parts throughout the views of the drawings.

DESCRIPTION OF THE PREFERRED EMBODIMENTS

Figure 1:
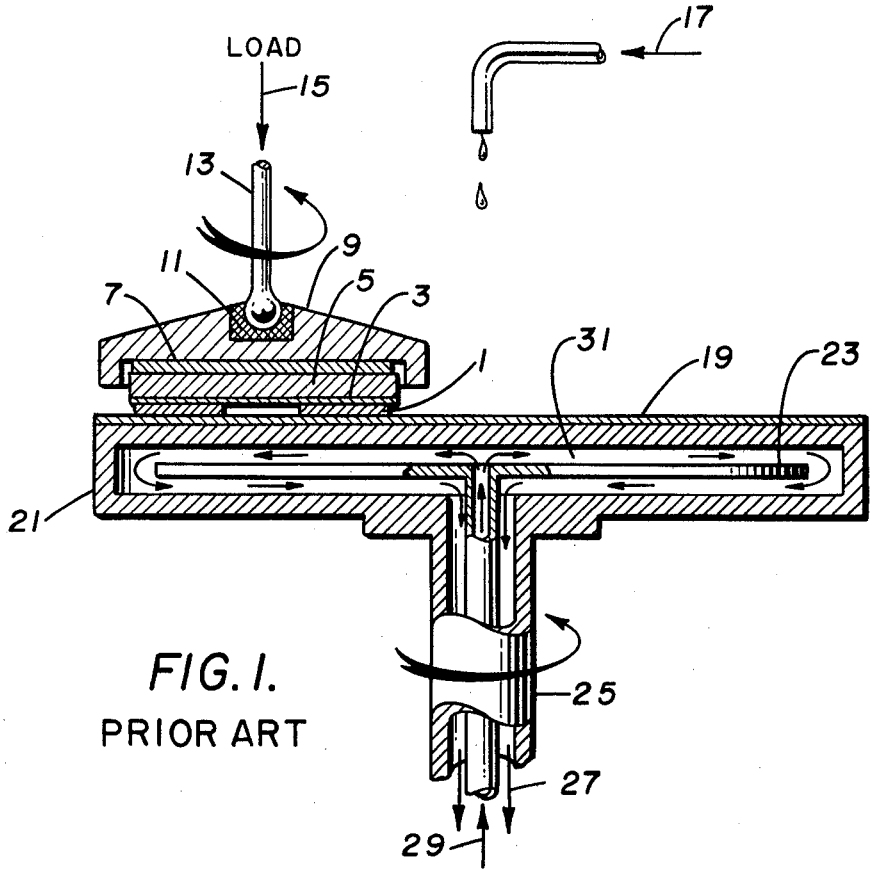
FIG. 1. PRIOR ART
FIG. 1 is a schematic illustration of prior art apparatus, illustrated in cross section, for carrying out a method for polishing wafers mounted on a carrier and pressure plate combination against a rotating turntable mounted polishing head. The apparatus as illustrated in FIG. 1 is representative of the prior art.

Referring to the drawings, current chemical-mechanical polishing processes for silicon and other semiconductor wafers are typically carried out on equipment as illustrated in FIG. 1. The wafers 1 are secured to the carrier 5 through mounting medium 3 which may be either a wax or any of several waxless mounting media which provide wafers with a friction, surface tension or other means for adhering to the carrier 5. The carrier is mounted through resilient pressure pad 7 means to pressure plate 9 which is suitably mounted to a spindle 13 through bearing mechanism 11, the spindle 13 and bearing 11 supporting a load 15 which is exerted against the pressure plate 9 and finally against wafers 1 when said wafers are in rotable contact with polishing pad 19 during operation, for example, when turntable 21 is rotating, thus forcing the rotation of the carrier 5 through friction means or independent drive means. The turntable 21 is rotated around shaft 25 which includes cooling water exit 27 and inlet 29 in communication with the hollow chamber inside the turntable, the chamber supporting the separation of the two streams through baffle 23.

Figure 2:
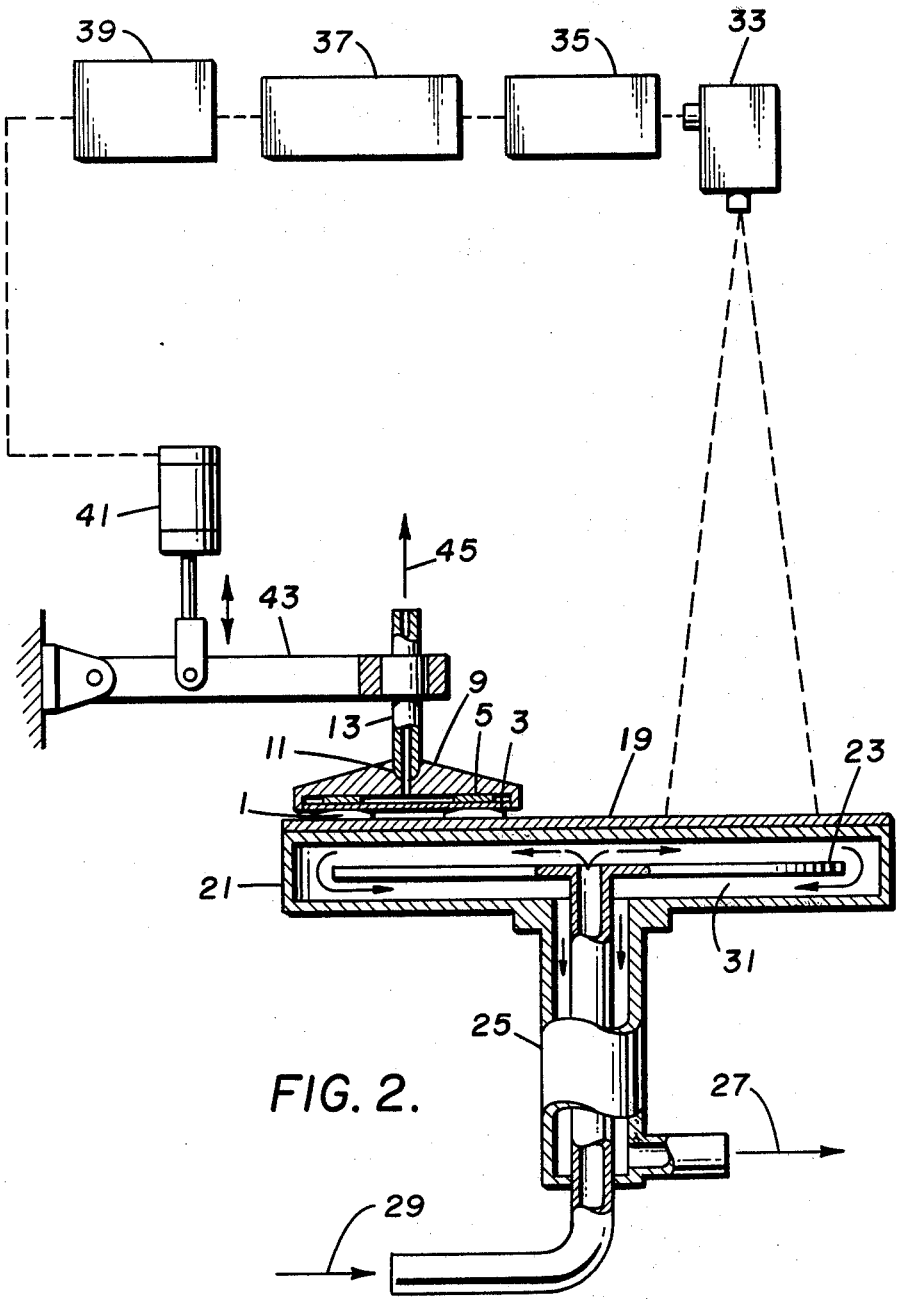
FIG. 2 is a schematic illustration of the apparatus according to the invention for carrying out the temperature control methodology for polishing wafers mounted on a carrier and pressure plate combination against an internally cooled rotating turntable mounted polishing head.

The greater polishing rates required today introduce increased loads and substantial power input into the polishing methodology. This increased speed and higher input appear as frictional heat at the wafer surface during polishing. In order to prevent excessive buildup, heat is removed from the system by cooling of the turntable as illustrated in FIGS. 1 and 2. When polishing silicon wafers with apparatus of the type illustrated in FIG. 1, it has been found that the stock removal is not uniform across the surfaces of the wafers mounted on the carrier but is greater toward the center of the carrier and less toward the outside edge of the carrier. This results in a general tapering of the wafers in the radial direction from the center of the carrier. It is not uncommon to encounter radial taper readings up to 15 micrometers on larger wafer sizes. Modern semiconductor technology has increased demand for larger diameter silicon wafers; therefore, the radial taper deficiency is further exaggerated by these diameter enlargements. Wafers with significant radial taper have relatively poor flatness; thus creating a serious problem for LSI and VLSI wafer applications.

The radial taper problem is substantially the result of distortion of the turntable from a flat surface or planar surface to an upwardly convex surface resulting from thermal and mechanical stress. Distortion is substantially caused by the heat flow from the wafer 1 surfaces to the cooling water which causes the top of the turntable to be at a higher temperature than the bottom surface which is essentially at the cooling water temperature. This temperature difference results in a thermal expansion differential causing the turntable surface and polishing pad 19 mounted thereon to deflect downward at the outside edge. The carrier 5 is thermally insulated from pressure plate 9 by resilient pressure pad 7. Various methodologies would have influence on resolving these problems, for example, such as partially eliminating the problem through reduction of the polishing rate, thus the heat flux until distortion is tolerable. However, such reduction of rate would greatly reduce the wafer throughput of the polishing apparatus and therefore increase wafer polishing costs.

A more economical solution is achieved through adjusting the geometry of the polishing environment to the necessary polishing rate and thermal bow of the turntable. These adjustments are very fine tuned and require instantaneous temperature control as well as finite temperature adjustment which is achieved through variation of the load or pressure upon the wafer polishing environment. FIG. 2, the unique system according to the invention for temperature control of the wafer polishing environment, provides a turntable 21 having cooling water supplied at a substantially constant temperature. The constant temperature water supply can be maintained at any level which will fit apparatus equipment for maintaining equipment warm or in operating condition when in fact operations are interrupted. The constant temperature water source allows for immediate use of equipment without warmup time and also provides instantaneous satisfactory use of the environment when the constant water temperature control is coordinated with the pressure temperature control as illustrated in FIG. 2 through utilization of infra red (IR) pad temperature sensor 33 which is in communication with temperature controller 35, current/pressure transducer 37 and ratio relay 39. These various closed loop controller elements communicate with piston means 41 in combination with load bearing lever 43 which completes the closed loop of electromechanical apparatus and methodology for instantaneously measuring and adjusting the wafer polishing environment temperature through load or pressure means.

The dual temperature control mechanism of the present invention allows the use of an elevated cooling fluid temperature which reduces the gradient between the top and bottom surfaces of the turntable and therefore reduces the bowing or thermal distortion. The reduced bowing simplifies the problem of flatness compensation which is achieved by creating a matching distortion of the wafer carrier plate.

According to the invention, polishing pad temperature control, i.e. wafer polishing environment temperature control, is achieved by immediate responsive closed loop control systems which varies the polishing pressure as necessary to hold the pad temperature, as measured by I.R. sensor 31, constant. Because of this dual temperature control system a constant temperature is maintained on both the top and bottom surfaces of the turntable which results in a constant level of thermal distortion. This can be compensated readily by generating a constant level of matching bow on the wafer carrier plate.

By comparison, prior art methods usually control polishing pad temperature by varying the flow rate of the turntable cooling water. This is a slower response system which gives less precise control. More importantly, however, varying the coolant flow rate changes the temperature gradient across the turntable and thus changes the thermal distortion, making it impossible to optimally compensate for the turntable distortion by using a constant distortion of the carrier plate.

Use requirements of the methodology and apparatus according to the invention could require a fluid coolant, water at an ambient temperature of about 34° C. for polishing of silicon wafers. Substantially constant water coolant temperature, within plus or minus 1.0° C., would be suitable for utilizing the merits of the dual polishing environment temperature control. The invention allows use of turntable 21 cooling as the major frictional heat sink while providing fine tuning of the temperature control through the closed loop assembly. The assembly functioning through electromechanical means for correcting temperature changes by positive or negative pressure movement of the pressure plate assembly relative to the rotatable turntable assembly supported polishing pad.

The silicon wafer utilization of the methodology and apparatus according to the invention could, for example, introduce cooling water at a warm ambient temperature of 34° C. and release water through cooling fluid exit 27 from the turntable cooling chamber 31 at approximately 37° C. The inventive methodology and apparatus provide water or other cooling fluids to the turntable fluid chamber 31 in such quantities as to not exceed an entry and exit temperature differential greater than about 6° C. Under such operation conditions, the i.r. radiation pyrometer 33 would transmit a signal of from 4 to 20 ma to the temperature controller 35 which would also provide a 4 to 20 ma signal to current/pressure transducer 37 which would provide a 3 to 15 psi output to the air pressure ratio relay 39. The ratio relay 39 would magnify the control signal pressure by a factor, for example, of 3 thereby providing a 9 to 45 psi pneumatic pressure to the piston means 41 which is in communication with pressure plate 9 through lever 43. In general, the inventive apparatus is capable of producing immediate pressure variation on the pressure plate mounted wafers of from about 1 to about 100 psi or greater. The foregoing represents a typical utilization of the invention for the polishing of silicon wafers utilizing the fine tuning temperature control, closed loop assembly and process according to the invention.

Although the foregoing includes a discussion of a possible use mode contemplated for carrying out the invention, various modifications can be made and still be within the spirit and scope of the inventive disclosure.

As various modifications can be made in the method and construction herein described and illustrated without departing from the scope of the invention, it is intended that all matter contained in the foregoing description or shown in the accompanying drawings, shall be interpreted as illustrative rather than limiting.

We claim:

1. The method of controlling the thermal bow distortion of a hollow internally cooled turntable having a polishing pad mounted on the top surface during polishing of semiconductor wafers held in pressurized rotatable contact with the polishing pad comprising:

circulating a heat transfer fluid through the turntable to maintain the bottom surface of the turntable at a constant temperature, sensing the temperature of said polishing pad, and regulating the pressure of the wafer against the polishing pad in response to said sensed temperature to maintain the polishing pad and top surface of the turntable at a constant temperature, whereby the temperature differential between the top and bottom surfaces of the turntable is maintained constant thereby maintaining the thermal bow distortion of the turntable constant.

2. The method of claim 1 wherein instantaneous regulation of said wafer pressure in response to polishing pad temperature is provided by closed loop control comprising in sequence:

sensing the polishing pad temperature, producing and transmitting an electrical signal indicative of said temperature, producing and transmitting an electrical control signal, producing and transmitting a pressure control signal, magnifying and transmitting a pressure control signal to a pressure means associated with the wafer.

3. The method of claim 2 wherein the polishing pad temperature is sensed indirectly by infra red radiation.

4. The method of claim 1 wherein said heat transfer fluid is introduced to the turntable at substantially constant temperature and flow rate.

5. The method of claim 4 wherein said heat transfer fluid is water and is introduced to the turntable at a temperature within plus or minus 1° C. and in such quantity as not to exceed an entry and exit temperature differential greater than about 6° C.

6. In a wafer polishing apparatus comprising:

a rotatable turntable assembly having an internal fluid chamber between an upper surface and a lower surface, a polishing pad supported on said upper surface and means for introducing and withdrawing a fluid to and from said fluid chamber, and a rotatable wafer holding assembly having a thin deformable carrier plate with a first surface for adhering wafers thereon, a rotatable pressure plate, and a resilient ring connecting a second surface of said carrier plate to said pressure plate and defining a chamber therebetween, a vacuum means communicating with said chamber for deforming said carrier plate to the curvature of said turntable upper surface and load bearing means for applying pressure to said pressure plate, said wafer holding assembly being positioned above and operatively associated with said turntable assembly for pressing wafers held on said first surface of the carrier plate against said polishing pad, the improvement comprising a closed loop control system having a polishing pad temperature sensing means communicating with electromechanical control means regulating said load bearing means.

7. The apparatus of claim 6 wherein said temperature sensing means comprises an infra red radiation pyrometer which transmits an electrical signal indicative of the polishing pad temperature to said electromechanical control means.

8. The apparatus of claim 6 wherein said closed loop control system comprises in sequential communication an infra red radiation pyrometer for sensing the polishing pad temperature and producing an electrical signal indicative of such temperature, a temperature controller for producing an electrical signal indicative of the variation of such temperature from a set temperature, a current-pressure transducer for converting such electrical signal to a pneumatic signal, and a pressure ratio relay for modifying the pneumatic signal for regulating said load bearings means.

9. The apparatus of claim 8 wherein said load bearing means comprises a pneumatic pressure activated piston operatively oonnected to a load bearing lever communicating with said wafer holding assembly for increasing or decreasing the pressure applied to said polishing pad.

* * * * *